US010696507B2

(12) United States Patent
Reichl

(10) Patent No.: US 10,696,507 B2
(45) Date of Patent: Jun. 30, 2020

(54) SPLICER ASSEMBLY

(71) Applicant: BHS Corrugated Maschinen—und Anlagenbau GmbH, Weiherhammer (DE)

(72) Inventor: Thomas Reichl, Altenstadt (DE)

(73) Assignee: BHS Corrugated Maschinen- und Anlagenbau GmbH, Weiherhammer (DE)

( * ) Notice: Subject to any disclaimer, the term of this patent is extended or adjusted under 35 U.S.C. 154(b) by 234 days.

(21) Appl. No.: 15/791,755

(22) Filed: Oct. 24, 2017

(65) Prior Publication Data

US 2018/0111776 A1 Apr. 26, 2018

(30) Foreign Application Priority Data

Oct. 25, 2016 (DE) ..... 10 2016 012 760

(51) Int. Cl.
*B65H 19/18* (2006.01)
*B65H 16/00* (2006.01)
*B65H 19/10* (2006.01)

(52) U.S. Cl.
CPC ..... *B65H 19/1805* (2013.01); *B65H 16/005* (2013.01); *B65H 19/102* (2013.01); *B65H 19/1852* (2013.01); *B65H 19/1857* (2013.01); *B65H 2301/4617* (2013.01); *B65H 2301/46017* (2013.01); *B65H 2301/4634* (2013.01); *B65H 2301/522* (2013.01); *B65H 2403/941* (2013.01); *B65H 2407/10* (2013.01); *B65H 2701/1762* (2013.01)

(58) Field of Classification Search
CPC ..... B65H 19/102; B65H 19/1805; B65H 19/1852; B65H 19/1857; B65H 16/005
See application file for complete search history.

(56) References Cited

U.S. PATENT DOCUMENTS 6,451,145 B1 9/2002 Forbes
2001/0035248 A1 11/2001 Sato et al.
(Continued)

FOREIGN PATENT DOCUMENTS

DE 38 16 223 A1 11/1989
DE 10 2011 115 936 A1 4/2012
(Continued)

*Primary Examiner* — Sang K Kim
(74) *Attorney, Agent, or Firm* — McGlew and Tuttle, P.C.

(57) ABSTRACT

The invention relates to a splicer assembly for splicing material webs. The splicer assembly comprises a first dispensing device for dispensing a finite first material web, a second dispensing device for dispensing a finite second material web, a connecting device for connecting the finite first material web and the finite second material web so as to form an endless material web, and a material web threading assistance assembly for assisted threading of the finite first material web or of the finite second material web into the splicer assembly in a threading procedure. The material web threading assistance device comprises at least one conveying installation for conveying the finite material web to be threaded in a threading direction in the threading procedure, and a conveying installation drive installation for driving the at least one conveying installation in the threading procedure.

20 Claims, 5 Drawing Sheets

(56) References Cited

U.S. PATENT DOCUMENTS

| | | | | |
|---|---|---|---|---|
| 2007/0075179 | A1* | 4/2007 | Mizutani | B65H 19/14<br>242/555.4 |
| 2012/0085483 | A1 | 4/2012 | Cummings | |
| 2015/0291380 | A1* | 10/2015 | Fischer | B65H 19/1805<br>242/552 |

FOREIGN PATENT DOCUMENTS

| | | | |
|---|---|---|---|
| EP | 0 341 605 | A2 | 11/1989 |
| EP | 0 453 727 | A2 | 10/1991 |

* cited by examiner

SPLICER ASSEMBLY

CROSS-REFERENCE TO RELATED APPLICATIONS

This application claims priority of German Patent Application Serial No. 10 2016 012 760.0 filed on Oct. 25, 2016, pursuant to 35 U.S.C. 119(a)-(d), the content of which is incorporated herein by reference in its entirety as if fully set forth herein.

FIELD OF THE INVENTION

The invention relates to a splicer assembly for splicing material webs. The invention furthermore relates to a method for splicing material webs.

BACKGROUND OF THE INVENTION

Known splicer assemblies connect a finite material web that runs out to a new finite material web such that a quasi endless material web is created. This procedure is referred to in the industry as splicing, and a respective assembly is referred to as a splicer assembly. The utilization of splicer assemblies of this type is not always at an optimum. Difficulties often arise in particular during the start-up. Starting up requires experience with corresponding splicer assemblies.

DE 38 16 223 A1 discloses a splicer assembly, wherein after threading an end of a prepared paper web, a knife carrier is moved into a pressing position in which a pressing face interacts with a holding roller.

A splicer is known from DE 10 2011 115 936 A1. A splice preparation involves threading a paper to be spliced through a splicer carriage, applying splice tape, cutting off excess paper, cutting lead-ins on the edge of the paper, removing a splice tape backing and indexing a prepared leading edge of the web for splice.

SUMMARY OF THE INVENTION

The invention is based on the object of providing a splicer assembly which is particularly easy to utilize. In particular, a splicer assembly which permits particularly user-friendly and trouble-free starting up is to be achieved. A respective method is likewise to be achieved.

This object is achieved according to the invention by a splicer assembly for splicing material webs, having a first dispensing device for dispensing a finite first material web, a second dispensing device for dispensing a finite second material web, a connecting device for connecting the finite first material web and the finite second material web so as to form an endless material web, and a material web threading assistance assembly for assisted threading of the finite first material web or of the finite second material web into the splicer assembly in a threading procedure, wherein the material web threading assistance assembly comprises at least one conveying installation for conveying the finite material web to be threaded in a threading direction in the threading procedure, and a conveying installation drive installation for driving the at least one conveying installation in the threading procedure.

This object is further achieved by a method for splicing material webs, comprising the following steps: dispensing a finite first material web by means of a first dispensing device, dispensing a finite second material web by means of a second dispensing device, connecting the finite first material web and the finite second material web by means of a connecting device so as to form an endless material web, and assisted threading of the finite first material web or of the finite second material web into the splicer assembly in a threading procedure by means of a material web threading assistance assembly, wherein at least one conveying installation of the material web threading assistance assembly in the threading procedure drives the finite material web to be threaded in a threading direction, and wherein a conveying installation drive installation of the material web threading assistance assembly in the threading procedure drives the at least one conveying installation.

The core concept of the invention lies in a material web threading assistance assembly which has an assisting or facilitating effect, respectively, in the threading of a new finite material web to the threaded into the splicer assembly in order for the latter to be started up. Particularly precise threading is thus possible. The finite material web to the threaded forms, for example, a cover web, a lamination web, an intermediate web, in particular of a corrugated cardboard web.

The at least one conveying installation in the threading procedure conveys the finite material web to be threaded in a threading direction through the splicer assembly. In order to be conveyed, the finite material web to be threaded herein at least in regions bears directly or indirectly on the at least one conveying installation. The at least one conveying installation is preferably rotatably drivable. Said at least one conveying installation is preferably formed by a conveying roller assembly. Alternatively, said at least one conveying installation is formed by a conveyor belt assembly, for example.

It is advantageous for the at least one conveying installation to extend perpendicularly to the threading direction and perpendicularly to the threading direction to have a width which corresponds to at least the width, perpendicular to the threading direction, of the finite material web to be threaded.

The conveying installation drive installation drives the at least one conveying installation in a corresponding manner. Said conveying installation drive installation has a direct or indirect driving connection to the at least one conveying installation. The conveying installation drive installation favourably comprises at least one drive, in particular an electric drive.

The threading direction favourably corresponds to the conveying direction of the endless material web when the latter is conveyed in a normal manner through the splicer assembly for producing a multi-layered web, in particular a corrugated cardboard web.

It is expedient for the material web threading assistance assembly to be disposed so as to be adjacent to a material web delivery of the splicer assembly.

The first dispensing device is preferably configured as a first unrolling device for unrolling a finite first material web from a first material roll. The second dispensing device is favourably configured as a second unrolling device for unrolling a finite second material web from a second material roll. Other configurations are alternatively possible.

It is expedient when the connecting device comprises a first preparation installation, a second preparation installation, a first connecting installation for connecting a web end of the finite first material web to a web lead of the finite second material web, a second connecting installation for connecting a web end of the finite second material web to a web lead of the finite first material web, and a table installation for interacting with the preparation installations and the connecting installations.

The splicer assembly moreover favourably has a storage truck which is displaceable longitudinally along a storage truck track or guide, respectively, in particular by virtue of a variation in the web tension. It is advantageous for a respective position of the storage truck to have an influence on a stored quantity of the stored endless material web in the splicer assembly. The stored quantity of the endless material web in the splicer assembly is preferably able to be increased or reduced, respectively, by displacing the storage truck. An uninterrupted conveyance of the endless material web is thus possible.

The splicer assembly preferably has an electric or electronic control unit, respectively, which in terms of signals is connected inter alia with the material web threading assistance assembly for activating the conveying installation drive installation.

The at least one conveying installation favourably conveys the finite material web to be threaded at a threading speed which is lower, preferably substantially lower, than a conveying speed of the splicer assembly when conveying the endless material web for production of a multi-layered web, in particular a corrugated cardboard web. Said threading speed is between 5 m/s and 15 m/s. It is advantageous when the threading speed of the finite material web to be threaded is at most 10%, more preferably at most 5%, most preferably at most 3% of the conveying speed of the endless material web of the splicer assembly or of a plant speed of a corrugated cardboard plant.

The material web threading assistance assembly, in particular the conveying installation drive installation, is manually activatable for the threading procedure. The manual activation is performed, for example, by pushing a button, or by switch, or the like, by an operator.

The design embodiment according to which the material web threading assistance assembly is able to be set in operation for the threading procedure only when a minimum safety spacing is maintained between a storage truck of the splicer assembly for conveying without interruptions the endless material web and the at least one conveying installation leads to a particularly reliable splicer assembly. Damage or risks, respectively, pertaining to the material web threading assistance assembly and/or to the storage truck are thus effectively preventable. The minimum safety spacing is favourably 100 mm, more preferably 120 mm. This can be checked by a corresponding monitoring assembly such as a sensor or camera assembly, for example.

The design embodiment according to which the material web threading assistance assembly in terms of the finite material web to be threaded is disposed downstream of the connecting device enables particularly reliable threading of the finite material web to be threaded.

The explanations made in the context of the design embodiment according to which the material web threading assistance assembly in terms of the finite material web to be threaded is disposed downstream of the connecting device apply to design embodiment according to which the material web threading assistance assembly in terms of the finite material web to be threaded is disposed upstream of a storage truck of the splicer assembly in an analogous manner.

The material web threading assistance assembly and a storage truck of the splicer assembly in the threading procedure are disposed so as to be mutually adjacent. The stored quantity of the stored endless material web is favourably minimal in this instance. The storage truck and the material web threading assistance assembly are then favourably disposed so as to be adjacent to a material web delivery of the splicer assembly.

The nominal torque the conveying installation drive installation in the threading procedure is impinged with preferably corresponds to a nominal value predefined by a control unit. It is expedient for the control unit to be embodied as a controller and/or regulator unit. The control unit in terms of signals is preferably connected to the monitoring assembly.

The configuration in which the at least one conveying installation conveys the threaded finite material web in the threading direction when traction is applied to the threaded finite material web in the threading direction downstream of the material web threading assistance assembly in terms of the threaded finite material web is extremely user-friendly. For example, when an operator manually exerts a respective tensile force on the threaded finite material web, the at least one conveying installation thus conveys the threaded finite material web in the threading direction. No slippage, or no substantial slippage, respectively, arises between the at least one conveying installation and the threaded finite material web in this instance. The threaded finite material web herein at least in regions bears firmly on the at least one conveying installation and by virtue of the friction force that is present between the threaded finite material web and the at least one conveying installation is thus conveyed in the threading direction.

The embodiment in which the at least one conveying installation conveys the threaded finite material web in the threading direction when traction is applied to the threaded finite material web in the threading direction downstream of the material web threading assistance assembly in terms of the threaded finite material web applies in a substantially analogous manner to the embodiment in which a conveyance of the threaded finite material web by the at least one conveying installation in the threading direction is omitted when insufficient traction is applied to the threaded finite material web in the threading direction downstream of the material web threading assistance assembly in terms of the threaded finite material web. In the case of an insufficient tensile force in the threading direction, slippage arises between the threaded finite material web and the at least one conveying installation. The threaded finite material web in this instance at least in regions is raised from the at least one conveying installation, for example while forming a loop, the latter being traceable to the reduced friction force between the threaded finite material web and the at least one conveying installation. The friction force between the threaded finite material web and the at least one conveying installation in the case of insufficient traction acting on the threaded finite material web is lower, preferably significantly lower, than in the case of tensile force being exerted. The threaded finite material web thus is adaptable and/or correctible in particular in terms of the position and/or orientation thereof.

Said threaded finite material web is thus displaceable perpendicularly to the threading direction, for example. An oblique orientation of the threaded finite material web is thus easy to compensate for. In particular, the threaded finite material web is positionable in the splicer assembly in a particularly simple and positive manner by exerting a corresponding traction on the threaded finite material web and by reducing said traction.

The at least one protective element of the material web threading assistance assembly which for the protection of an operator at least in regions is disposed so as to be adjacent to the at least one conveying installation and/or conveying installation drive installation effectively prevents injury to an operator. Said protective element is preferably embodied as a profiled part. It is advantageous for the at least one protective element to extend, perpendicularly to the threading direction, across the entire width of the material web threading assistance assembly.

The splicer assembly in which the at least one conveying installation at least in regions externally has a friction face for engaging on the finite material web to be threaded permits conveying or setting in motion, respectively, of the finite material web to be threaded in a particularly functionally reliable manner. In particular, a particularly high level of adhesion is present between the at least one conveying installation and the finite material web to be threaded. This applies above all when traction in the threading direction downstream of the material web threading assistance assembly is exerted on the threaded finite material web. To this end, it is advantageous for the at least one conveying installation to have a respective coating, for example a corresponding hard ceramic coating, in particular a tungsten-carbide coating, on the external side or on the circumferential side, respectively.

The splicer assembly in which the at least one conveying installation is formed by at least one conveying roller, wherein two of the conveying rollers are favourably present, wherein the conveying rollers in the threading procedure are favourably driven in mutually opposite directions, wherein the conveying rollers are favourably intercoupled by a coupling assembly, also enables conveying of the finite material web to be threaded in a particularly functionally reliable manner. The at least one conveying roller is preferably rotatably driveable for the threading procedure.

The conveying rollers are favourably disposed so as to be mutually spaced apart. Said conveying rollers are preferably disposed so as to be mutually spaced apart while forming a conveying gap, and preferably extend so as to be mutually parallel.

The coupling assembly is favourably a component part of the conveying installation drive installation. Said coupling assembly is favourably formed by a gearbox, in particular a set of gears, more preferably a spur gear.

The splicer assembly is favourably a component part of a corrugated cardboard plant. Such a corrugated cardboard plant preferably has a plurality of the splicer assemblies. It is expedient for the corrugated cardboard plant to have at least one corrugated cardboard production device for generating at least one endless corrugated cardboard web that is laminated on one side. It is advantageous for such a corrugated cardboard plant to furthermore comprise a connecting device for connecting the at least one endless corrugated cardboard web that is laminated on one side to an endless lamination web, while forming an at least triple-layered corrugated cardboard web. The corrugated cardboard plant favourably has a cutting device for generating corrugated cardboard sheets from the at least triple-layered endless corrugated cardboard web. It is advantageous for a stacking device for stacking the corrugated cardboard sheets to be disposed downstream of the at least one cutting device. The corrugated cardboard plant is capable of generating, for example, triple-layered, quintuple-layered, . . . corrugated cardboard webs.

A preferred embodiment of the invention will be described in an exemplary manner hereunder with reference to the appended drawing.

DESCRIPTION OF THE PREFERRED EMBODIMENT

Figure 1:
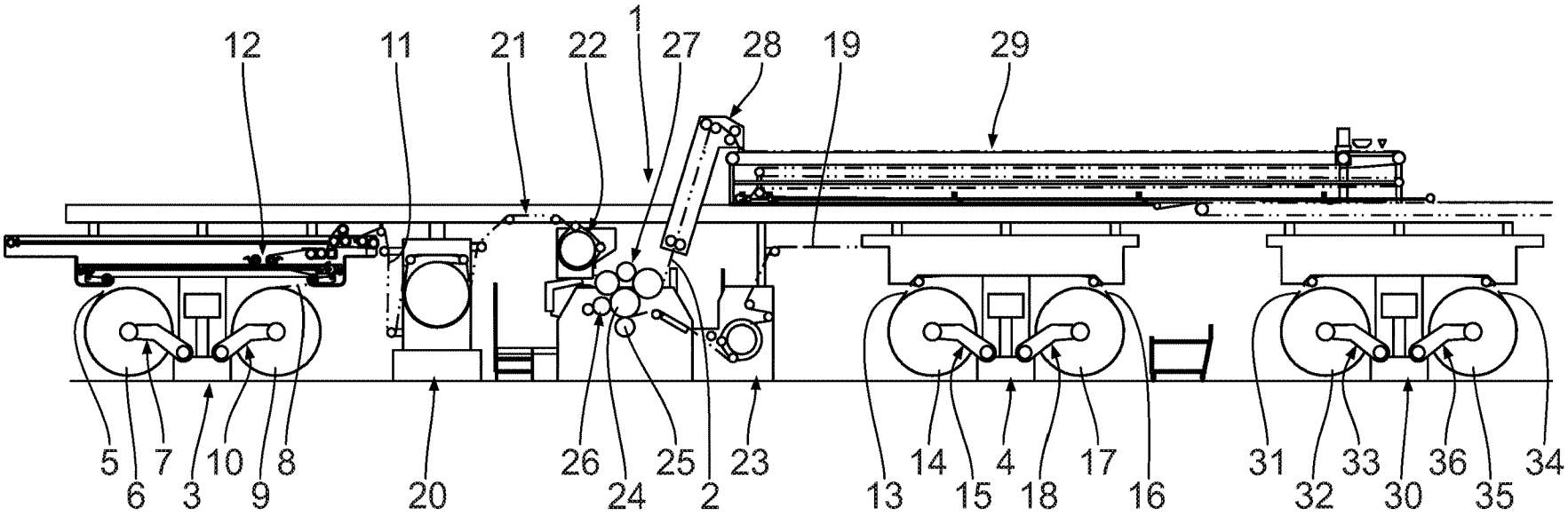
FIG. 1 shows a partial lateral view of a corrugated cardboard plant having splicer assemblies according to the invention.

Referring first to FIG. 1, a corrugated cardboard plant comprises a corrugated cardboard production device 1 for producing an endless corrugated cardboard web 2 that is laminated on one side.

A cover web splicer assembly 3 and an intermediate web splicer assembly 4 are disposed upstream of the corrugated cardboard production device 1.

The used terms "disposed upstream", "disposed downstream", "upstream", "downstream" or the like refer in particular to the conveying direction of the respective web.

The cover web splicer assembly 3 for unrolling a finite first cover web 5 from a first cover web roll 6 comprises a first unrolling device 7, and for unrolling a finite second cover web 8 from a second cover web roll 9 comprises a second unrolling device 10. The finite first cover web 5 and the finite cover web 8 for providing an endless cover web 11 are interconnected by means of a connecting and cutting device 12 of the cover web splicer assembly 3.

The intermediate web splicer assembly 4 is configured in a manner corresponding to that of the cover web splicer assembly 3. Said intermediate web splicer assembly 4 for unrolling a finite first intermediate web 13 from a first intermediate web roll 14 comprises a third unrolling device 15, and for unrolling a finite second intermediate web 16 from a second intermediate web roll 17 comprises a fourth unrolling device 18. The finite first intermediate web 13 and the finite second intermediate web 16 for providing an endless intermediate web 19 are interconnected by means of a connecting and cutting device (not illustrated) of the intermediate splicer assembly 4.

The endless cover web 11 by way of a heating installation 20 and of a deflection roller assembly 21 and of a first web tensioning installation 22 is fed to the corrugated cardboard production device 1, while the endless intermediate web 19 by way of a second web tensioning installation 23 is fed to the corrugated cardboard production device 1.

The corrugated cardboard production device 1, for generating an endless corrugated web that has a corrugation from the endless intermediate web 19, comprises a corrugation roller assembly having a first corrugation roller 24 and a second corrugation roller 25. The corrugation rollers 24, 25 configure a roller gap for guiding through and corrugating the endless intermediate web 19. The rotation axes of the corrugation rollers 24, 25 run so as to be mutually parallel.

The corrugated cardboard production device 1, for connecting the endless cover web 11 to the endless corrugated intermediate web, or corrugated web 19, respectively, to form the endless corrugated cardboard web 2 that is laminated on one side, has a glue application installation 26 which favourably comprises a glue metering roller, a glue tank, and a glue application roller. The glue application roller and the first corrugation roller 24 conjointly configure a glue gap for guiding through and gluing the endless corrugated web 19. The glue that is located in the glue tank is applied by way of the glue application roller onto tips of the corrugation of the endless corrugated web 19. The glue metering roller bears on the glue application roller and serves for forming a uniform glue layer on the glue application roller.

The endless cover web 11 in the corrugated cardboard production device 1 is subsequently joined to the endless intermediate web 19 that is provided with glue from the glue tank, so as to produce the endless corrugated cardboard web 2 that is laminated on one side.

The corrugated cardboard production device 1, for pressing the endless cover web 11 against the endless corrugated web 19 that is provided with glue and in turn in regions bears on the first corrugation roller 24, has a contact pressure module 27. The contact pressure module 27 is favourably embodied as a contact pressure belt module. Said contact pressure module 27 is disposed above the first corrugation roller 24. Said contact pressure module 27 has at least two contact pressure deflection rollers and one endless contact pressure belt which is guided about the contact pressure deflection rollers. The first corrugation roller 24 in regions engages from below into a space between two external contact pressure rollers of the contact pressure belt 27, on account of which the contact pressure belt is deflected by the first corrugation roller 24. The contact pressure belt presses against the endless cover web 11 which in turn is pressed against the endless corrugated web 19 that is provided with glue and bears on the first corrugation roller 24.

In order for the endless corrugated cardboard web 2 that is laminated on one side to be temporarily stored and buffered, the latter by way of an overhead transportation installation 28 is fed to a storage device 29 of the corrugated cardboard plant, said storage device 29 forming loops.

The corrugated cardboard plant moreover comprises a lamination web splicer assembly 30 which is embodied in a manner corresponding to that of the cover web splicer assembly 3 or of the intermediate web splicer assembly 4, respectively. The lamination web splicer assembly 30 for unrolling a finite first lamination web 31 from a first lamination web roll 32 has a fifth unrolling device 33, and for unrolling a finite second lamination web 34 from a second lamination web roll 35 has a sixth unrolling device 36. The finite first lamination web 31 and the finite second lamination web 34 for providing an endless lamination web are interconnected by means of a connecting and cutting device of the lamination web splicer assembly 30.

The corrugated cardboard plant, downstream of the storage device 29 and the lamination web splicer assembly 30, has a preheating device (not illustrated) having two preheating rollers disposed one above the other. The endless corrugated cardboard web 2 that is laminated on one side and the endless lamination web are fed to the preheating device, which webs wrap around the respective preheating roller in regions on the circumferential side.

The corrugated cardboard plant, downstream of the preheating device, has a gluing unit (not illustrated) having a gluing roller which is partially immersed in a glue bath. A glue metering roller bears on the gluing roller so as to configure a uniform glue layer on the gluing roller. The endless corrugated cardboard web 2 that is laminated on one side, by way of the corrugated web 19 thereof, is in contact with the gluing roller such that the corrugation of said corrugated web 19 is provided with glue from the glue bath.

The corrugated cardboard plant, downstream of the gluing unit, has a heated compression device (not illustrated) which comprises a horizontally running heated table. An endless compression belt that is guided about guide rollers is disposed so as to be adjacent to the heated table. A compression gap through which the corrugated cardboard web 2 that is laminated on one side and the endless lamination web are guided while forming an endless triple-layered corrugated cardboard web (not illustrated) is configured between the compression belt and the heated table.

The corrugated cardboard plant, downstream of the heated compression device, has a short transverse cutting device (not illustrated), the latter serving for cutting out rejects from the endless triple-layered corrugated cardboard web.

The corrugated cardboard plant, downstream of the short transverse cutting device, has a longitudinal cutting/corrugating device (not illustrated) for longitudinally cutting and corrugating the endless triple-layered corrugated cardboard web. Endless part-webs which initially still run beside one another can be generated from the endless triple-layered corrugated cardboard web in the longitudinal cutting/corrugating device.

The corrugated cardboard plant, downstream of the longitudinal cutting/corrugating device, has a turnout (not illustrated) in order for the part-webs to be conveyed to different levels.

The corrugated cardboard plant, downstream of the turnout, has a transverse cutting device (not illustrated) having transverse cutting installations that are disposed on top of one another. The transverse cutting installations generate corrugated cardboard sheets from the part-webs.

The corrugated cardboard plant, downstream of the transverse cutting installations, has a stacking device (not illustrated) which stacks the corrugated cardboard sheets.

Since the splicer assemblies 3, 4, 30 are identical, for the sake of brevity only the cover web splicer assembly 3 will be discussed in more detail and in an exemplary manner hereunder. These explanations thus also apply to the intermediate web splicer assembly 4 and to the lamination web splicer assembly 30, respectively.

The finite first cover web 5 by way of a first feed roller 37 of the connecting and cutting device 12 is fed to the cover web splicer assembly 3, while the finite second material web 8 by way of a second feed roller 38 is fed to said connecting and cutting device 12. Each feed roller 37, 38 is rotatably mounted on a first or second support arm 39, 40, respectively, the latter for tensioning the respective finite cover web 5, 8 being disposed so as to be pivotable on a main frame support 41 of the cover web splice assembly 3 above the respective cover web roll 6 or 9, respectively. The main frame support 41 is disposed on an end region of a main frame stand 43 that is opposite a main frame base 42. The main frame support 41 runs so as to be substantially parallel with a floor and horizontally.

As mentioned, the connecting and cutting device 12 of the cover web splicer assembly 3 serves for producing the endless cover web 11 from the finite cover webs 5, 8. Said connecting and cutting device 12 comprises a first preparation installation 44, a second preparation installation 45, a first connecting installation 46, a second connecting installation 47, and a table installation 48, and a guide 49.

According to FIGS. 1, 2, 4, and 5, the first preparation installation 44 is located in the main frame support 41, in a region above the first cover web roll 6, while the second preparation installation 45 is located in the region of the second cover roll 9, so as to be above the latter, in the main frame support 41.

The guide 49, between the two preparation installations 44, 45 that in FIGS. 1, 2, 4, and 5 are disposed on the end sides, runs straight in/on the main frame support 41 and parallel with the floor, wherein the preparation installations 44, 45 are displaceable along the guide 49.

The table installation 49 is likewise displaceable along the guide 49. Said table installation 48 is disposed between the two preparation installations 44, 45. The preparation installations 44, 45 and the table installation 48 are displaceable along the guide 49 and relative to the connecting installations 46, 47.

The connecting installations 46, 47 are disposed so as to be mutually spaced apart longitudinally on the guide 49. Said connecting installations 46, 47 are disposed on the main frame support 41, above the guide 49.

The preparation installations 44, 45 are of identical construction and are disposed so as to be symmetrical in relation to a vertically running symmetry plane.

The first preparation installation 44, for feeding the finite first cover web 5, has a rotatably mounted first transportation or holding roller 50, respectively, and a first transverse cutting unit 51, for example for cutting transversely the infed finite first cover web 5.

The second preparation installation 45, for feeding the finite second cover web 8, has a rotatably mounted second transportation or holding roller 52, respectively, and a second transverse cutting unit 53, for example for cutting transversely the infed finite second cover web 8.

Each preparation installation 44, 45, for the displacement thereof along the guide 49, has a dedicated first and second displacement drive, respectively.

The connecting installations 46, 47 are of identical construction and are disposed on the main frame support 41 so as to be symmetrical in relation to a vertically running symmetry plane.

The first connecting installation 46, for cutting the finite first cover web 5 prior to connecting the latter to the finite second cover web 8, comprises a first cutting unit 54, and for connecting the finite cover webs 5, 8 to form the endless cover web 11 comprises a first contact pressure roller 55. The first cutting unit 54 and the first contact pressure roller 55 are disposed on the main frame support 41 so as to be directly adjacent to the guide 49 in such a manner that the transportation or holding rollers 50, 52, respectively, of the preparation installations 44, 45, and the table installation 48, are guidable along the guide 49 so as to pass the first connecting installation 46.

The first contact pressure roller 55, in a corresponding displaced position of the second transportation or holding roller 52, respectively, conjointly with the latter configures a connecting gap for guiding through the finite cover webs 5, 8 to be connected and an adhesive tape, which for connecting to the finite first cover web 5, or to the endless cover web 11, respectively, has previously been manually attached in a corresponding manner to a web lead of the finite second cover web 8.

The second connecting installation 47, for cutting the finite second cover web 8 prior to connecting the latter to the finite first cover web 5, comprises a second cutting unit 56, and for connecting the finite cover webs 5, 8 to form the endless cover web 11 comprises a second contact pressure roller 57. The second cutting unit 56 and the second contact pressure roller 57 are disposed on the main frame support 41 so as to be directly adjacent to the guide 49 in such a manner that the transportation or holding rollers 50, 52, respectively, of the preparation installations 44, 45, and the table installation 48, are guidable along the guide 49 so as to pass the second connecting installation 47.

The second contact pressure roller 57, in a corresponding displaced position of the first transportation or holding roller 50, respectively, conjointly with the latter configures a connecting gap for guiding through the finite cover webs 5, 8 to be connected and an adhesive tape, which for connecting to the finite second cover web 8, or to the endless cover web 11, respectively, has previously been manually attached in a corresponding manner to a web lead of the finite first cover web 5.

The table installation 48, depending on the position thereof, interacts with the first preparation installation 46, the second preparation installation 47, the first connecting installation 46 and the second connecting installation 47, respectively, and is displaceable along the guide 49, in particular in a manner independent of said first preparation installation 46, said second preparation installation 47, said first connecting installation 46 and said second connecting installation 47, respectively.

A material web threading assistance assembly 59 which is disposed so as to be substantially above the second support arm 40 on the main frame support 41 is disposed so as to be downstream of the connecting and cutting device 12 in the conveying direction 58 of the endless cover web 11, or of the finite first cover web 5, or of the finite second cover web 8.

The material web threading assistance assembly 59 comprises two mutually opposite frame walls 60 which are fastened to the main frame support 41.

The material web threading assistance assembly 59 furthermore has a first conveying roller 61 and a second conveying roller 62 which are mounted so as to be rotatably drivable in the frame walls 60. The conveying rollers 61, 62 are identical and run so as to be mutually parallel. Said conveying rollers 61, 62 extend perpendicularly to the conveying direction 58. The conveying rollers 61, 62 on the circumferential side have a tungsten-carbide coating. Said conveying rollers 61, 62 form conveying installations.

The conveying rollers 61, 62 conjointly form a conveying gap 63 through which the endless cover web 11, or the finite first cover web 5, or the finite second cover web 8, respectively, runs. The endless cover web 11, or the finite first cover web 5, or the finite second cover web 8, respectively, bears on the conveying rollers 61, 62 so as to be adjacent to the conveying gap 63. The conveying rollers 61, 62 in the conveying gap 63 favourably do not exert any compressive force on the endless cover web 11, or the finite first cover web 5, or the finite second cover web 8.

The material web threading assistance assembly 59 furthermore comprises two conveying roller drives 64 which form a drive installation, each having one drive shaft 65. Each conveying roller drive 64 is fastened to the inside of one of the frame walls 60. The drive shafts 65 are in mutual alignment and run parallel with the conveying rollers 61, 62. One drive sprocket 66 is disposed in a rotationally fixed manner on each drive shaft 65.

Each drive sprocket 66, while forming in particular a helical-cut spur gearing, meshes with a coupling gear wheel 67 which is rotatably mounted on the respective frame wall 60.

Two first drive gear wheels 68 are disposed in a rotationally fixed manner, so as to be mutually opposite, on the first conveying roller 61. Two second drive gear wheels 69 are disposed in a rotationally fixed manner, so as to be mutually opposite, on the second conveying roller 62. The drive gear wheels 68, 69 are identical.

Each coupling gear wheel 67, while forming a, in particular helical-cut, spur gearing, meshes with a second drive gear wheel 69 which in turn, while forming a, in particular helical-cut, spur gearing, meshes with a first drive gear wheel 68. The conveying rollers 61, 62 are thus mutually coupled and rotatably drivable in opposite directions.

Overall, the material web threading assistance assembly 59 has two gearbox-type coupling assemblies. Each coupling assembly is disposed so as to be adjacent to a frame wall 60 and so as to be external to the latter. Each coupling assembly is formed by a drive sprocket 66, a coupling gear wheel 67 and a first drive gear wheel 68 and a second drive gear wheel 69, all meshing with one another. Each coupling assembly is accommodated in a protective panel 70 which is fastened to the outside of the adjacent frame wall 60.

The material web threading assistance assembly 59 furthermore has a first guard panel element 71 which extends above the first conveying roller 61 and the conveying gap 63. The first guard panel element 71 runs along the entire first conveying roller 61. A second guard panel element 72 of the material web threading assistance assembly 59 extends below the second conveying roller 62 and also covers a region of the second conveying roller 62 that faces away from the first conveying roller 61. Said second guard panel element 72 extends along the entire second conveying roller 62.

Each conveying roller drive 64 is assigned a revolution sensor 73. Each revolution sensor 73 is capable of detecting the currently prevailing number of revolutions of the conveying roller drive 64, in particular of the drive shaft 65, thereof. Each revolution sensor 73 in terms of signals is connected to an electronic control unit 74 which comprises a nominal-value predefining unit 75 for predefining nominal values, in particular for the respective conveying roller drive 64.

A first deflection roller 75 which is rotatably mounted on a storage truck 76 is disposed downstream of the material web threading assistance assembly 59 in terms of the conveying direction 58. The storage truck 76 is disposed in that region of an upper end of the main frame support 41 in the cover web splicer assembly 3 that faces away from the main frame stand 43 and is displaceable along a storage truck guide 77 which extends parallel with the floor and above the guide 49 in the cover web splicer assembly 3. The storage truck guide 77 predefines a displacement track for the storage truck 76 and extends substantially along the entire main frame support 41. The storage truck 76 herein is displaceable between a first terminal position and a second terminal position. Said storage truck 76 is displaceable in opposite displacement directions.

The storage truck 76 in the first terminal position is disposed so as to be adjacent to a material web delivery 78 of the cover web splicer assembly 3, while the storage truck 76 in the second terminal position is located so as to be spaced apart from, or remote from, respectively, the material web delivery 78 of the cover web splicer assembly 3. According to FIGS. 1, 2, 4, and 5, the storage truck 76 in the first terminal position is located so as to be adjacent to the material web delivery 78.

In order for the endless cover web 11, or the finite first cover web 5, or the finite second cover web 8, respectively, to be deflected, a second deflection roller 79 is rotatably mounted on the main frame support 41 of the cover web splicer assembly 3 in the region of the material web delivery 78, above the storage truck 76. The second deflection roller 79 in terms of the conveying direction 58 is disposed downstream of the first deflection roller 75.

A third deflection roller 80 which is rotatably mounted on the storage truck 76 and is disposed so as to be adjacent to the first deflection roller 75 is disposed downstream of the second deflection roller 79 in terms of the conveying direction 58. The third deflection roller 80 has a smaller spacing from the material web delivery 78 than the first deflection roller 75.

In order for the endless cover web 11, or the finite first cover web 5, or the finite second cover web 8 to be deflected, a fourth deflection roller 81 is rotatably mounted so as to be level with the storage truck guide 77 on the main frame support 41 in the region of the material web delivery 78. The fourth deflection roller 81 in terms of the conveying direction 58 is disposed downstream of the third deflection roller 80.

A fifth deflection roller 82 which is rotatably mounted on the storage truck 76 is disposed downstream of the fourth deflection roller 81 in terms of the conveying direction 58. The third deflection roller 80 is disposed between the first deflection roller 75 and the fifth deflection roller 82. The rotation axes of the deflection rollers 75, 80, 82 run so as to be mutually parallel and lie in a common, in particular horizontal, plane.

By virtue of the identical configuration of the cover web splicer assembly 3, of the intermediate web splicer assembly 4, and of the lamination web splicer assembly 30, the intermediate web splicer assembly 4 and the lamination web splicer assembly 30 thus also have a material web threading assistance assembly 59.

The threading of the finite second cover web 8 into the cover web splicer assembly 3 will be described in an exemplary manner hereunder. Splicing per se will not be discussed in more detail, since this is performed in a known manner. The threading of a finite material web into the intermediate web splicer assembly 4, or into the lamination web splicer assembly 30, respectively, is performed in an analogous manner such that a respective description can be dispensed with in order to avoid unnecessary repetitions.

The storage truck 76 prior to the threading procedure is located at the second terminal position, so as to be spaced apart from the material web delivery 78.

Figure 2:
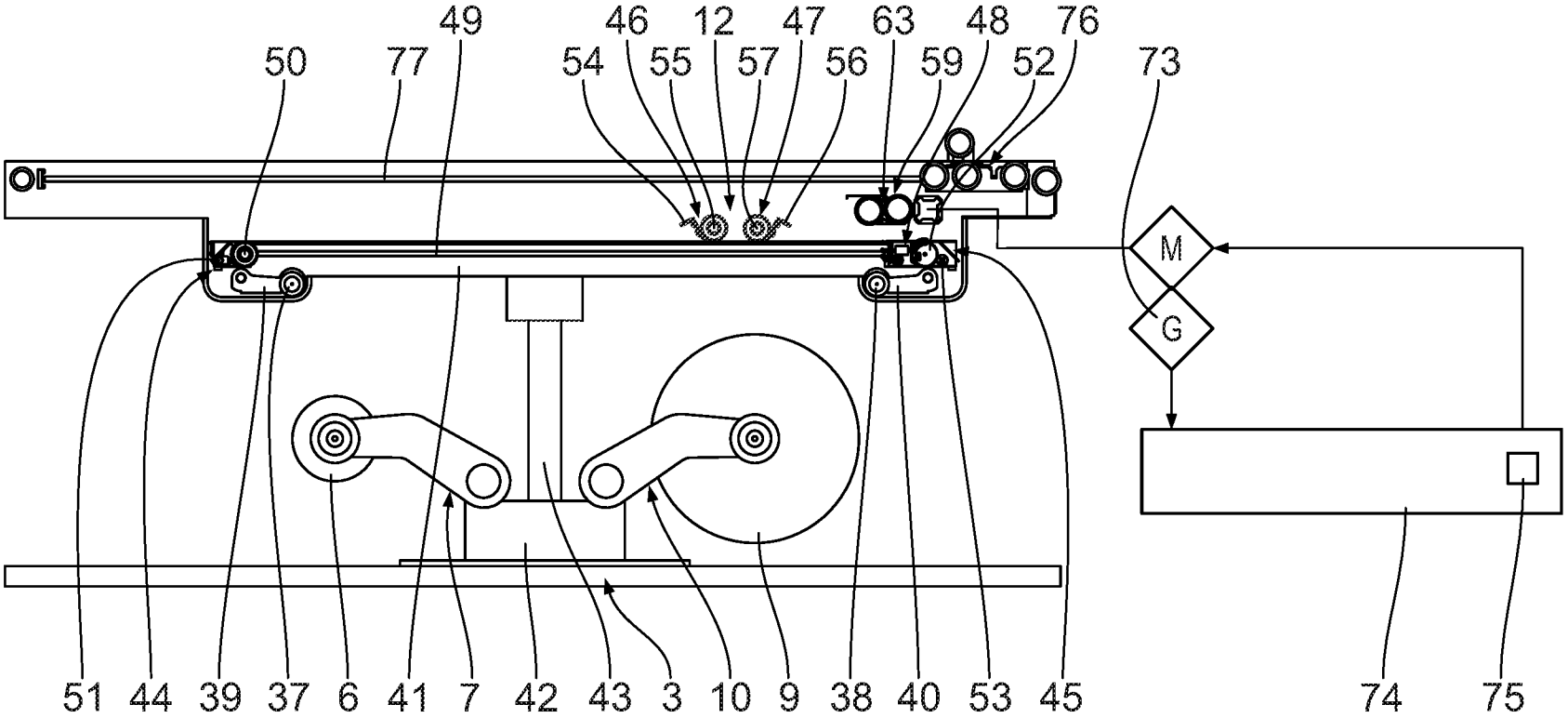
FIG. 2 shows a lateral view which in an exemplary manner visualizes a splicer assembly of the corrugated cardboard plant according to FIG. 1 and how said corrugated cardboard plant is regulated.
Figure 3:
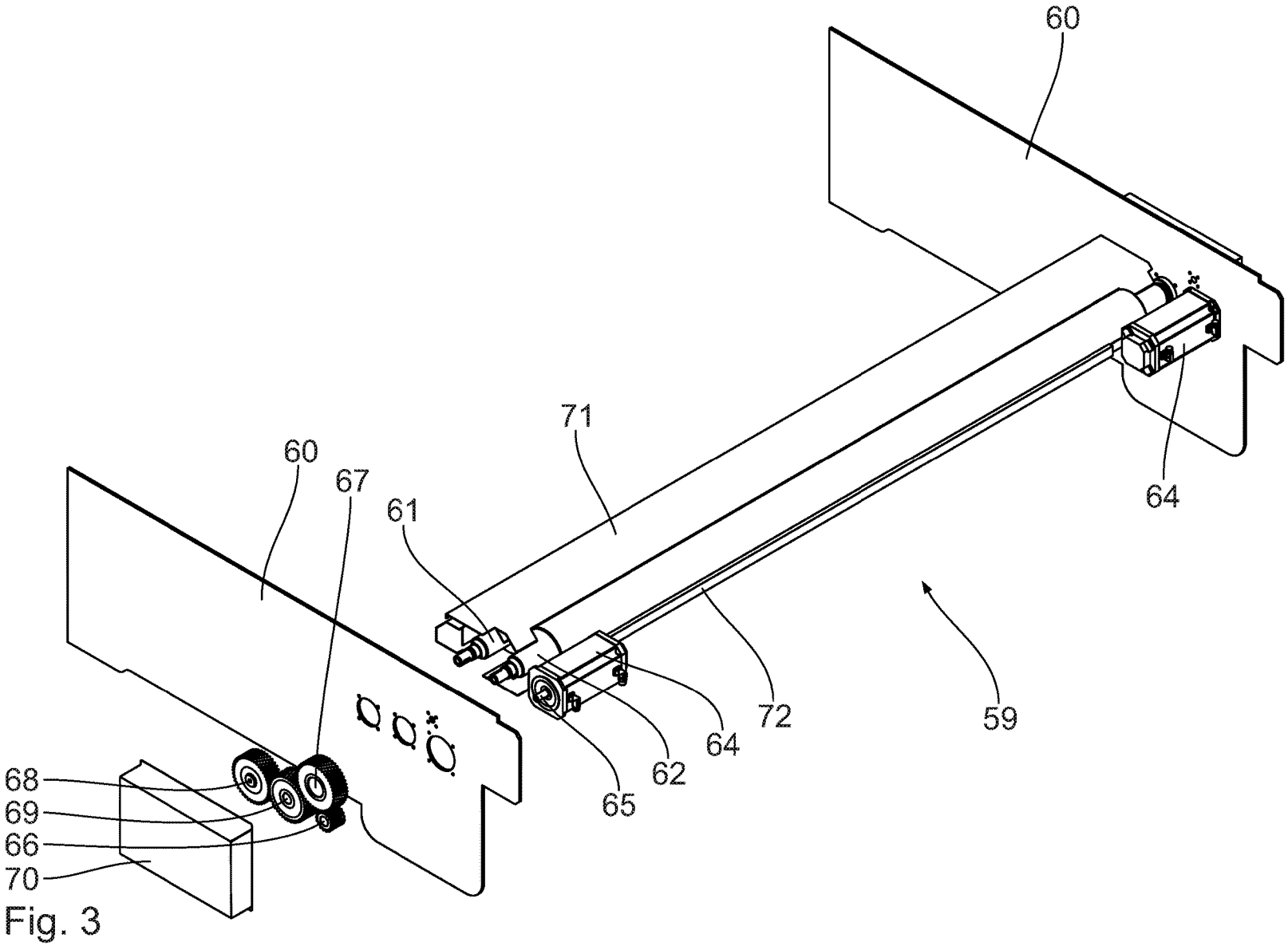
FIG. 3 shows a perspective view which visualizes the construction of the material web threading assistance assembly of the splicer assembly according to FIG. 2.

For the threading procedure, the storage truck 76 is displaced along the storage truck guide 77 to the first terminal position, this being visualized in FIG. 2. The control unit 74 first checks whether the safety spacing x required for carrying out the threading procedure is present between the conveying roller drives 64 and the storage truck 76. In the affirmative, the material web threading assistance assembly 59 can be set in operation by an operator (not illustrated). The conveying roller drives 64 are thus activatable for the threading procedure. The second preparation installation 45 and the table installation 48 are moved to a holding position adjacent to the second feed roller 38.

The finite second cover web 8 by way of the second feed roller 38, where the finite second cover web 8 is deflected by approximately 30° to 50°, is guided to the connecting and cutting device 12. The second finite cover web 8 is guided through between the first contact pressure roller 55 and the second contact pressure roller 57. Said second finite cover web 8 in regions bears on the circumferential side of the second contact pressure roller 57 and is deflected.

The finite second cover web 8 is then guided under the first guard panel element 71 to the first conveying roller 61. The finite second cover web 8 is then introduced from above into the conveying gap 63. Said finite second cover web 8 then runs between the second guard panel element 72 and the second conveying roller 62. The finite second cover web 8 is wrapped around the two conveying rollers 61, 62 and in regions bears on the circumferential side of said two conveying rollers 61, 62.

The second finite cover web 8 is subsequently guided around the first deflection roller 75 on the storage truck 76. The finite second cover web 8 is subsequently guided around the locationally fixed second deflection roller 79. The finite second cover web 8 is subsequently guided around the third deflection roller 80 on the storage truck 76. The finite second cover web 8 is subsequently guided around the locationally fixed fourth deflection roller 81. The finite second cover web 8 is subsequently guided around the fifth deflection roller 82 on the storage truck 76. The finite second cover web 8 by way of the material web delivery 78 subsequently exits the cover web splicing device 3.

The two conveying rollers 61, 62 by the conveying roller drives 64 are driven about the rotation axes of the former at a threading circumferential speed of 5 m/min to 15 m/min in such a manner that the threading procedure is facilitated by the conveying rollers 61, 62 in an assisting manner.

Figure 4:
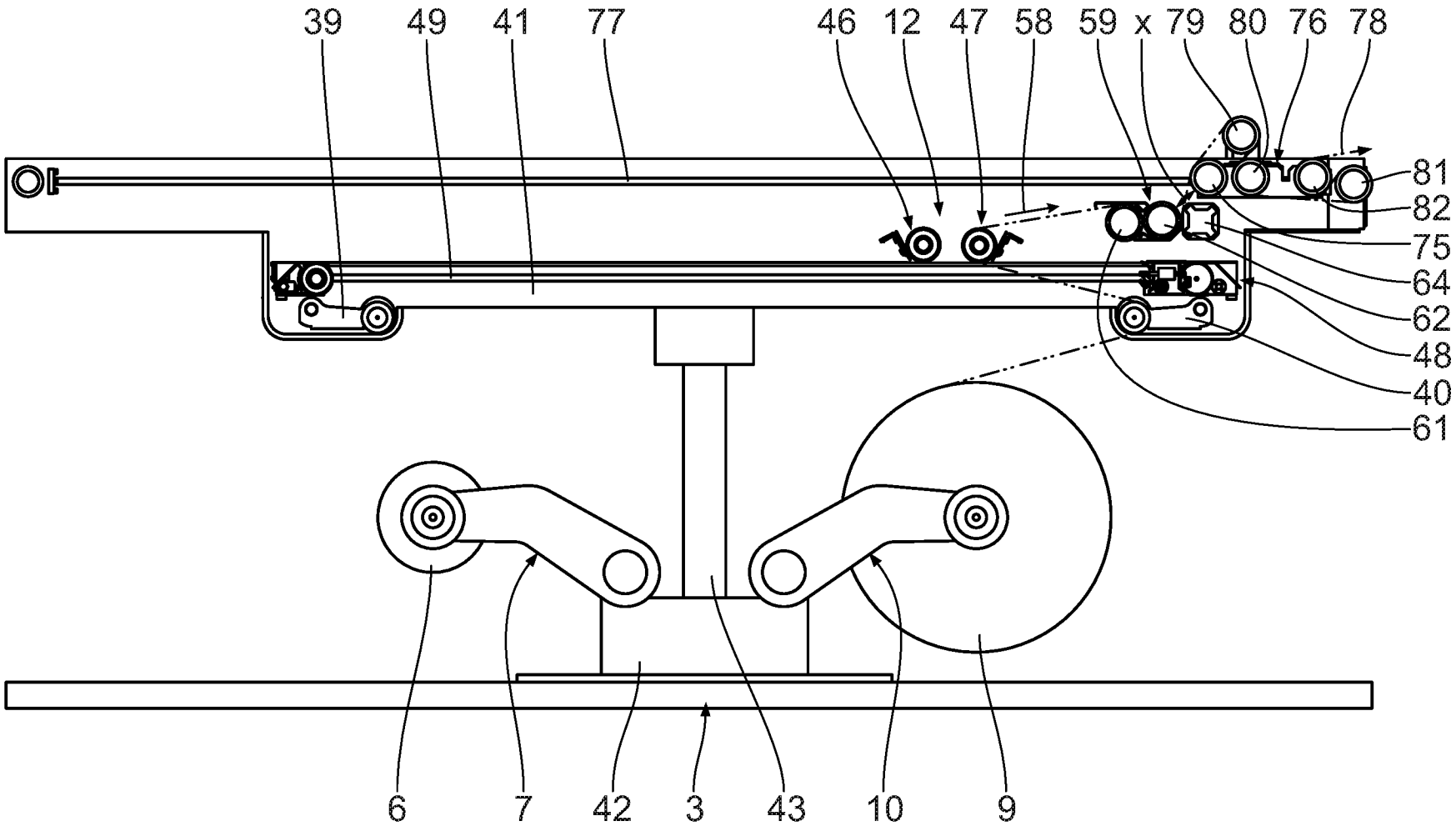
FIG. 4 shows a lateral view of the splicer assembly according to FIG. 2, wherein the behaviour when a tensile force is exerted by an operator on the threaded finite material web is visualized.

In order for the conveying rollers 61, 62 to convey the finite second cover web 8 in the conveying direction 58, a respective tensile force is manually applied by an operator to the finite second cover web 8 at the material delivery 78, this being visualized by the traction arrow in FIG. 4. The friction between the conveying rollers 61, 62 and the finite second cover web 8 in this instance is sufficient for the finite second cover web 8 to be conveyed through the rotating conveying rollers 61, 62. The conveying rollers 61, 62 under friction herein engage on the finite second cover web 8, conveying the latter at a threading speed in the conveying direction 58. The conveying rollers 61, 62 herein engage on the finite second cover web 8 across the entire width such that the material web threading assistance assembly 59 is advantageous in particular in the case of heavy web rolls or light webs, respectively.

Figure 5:
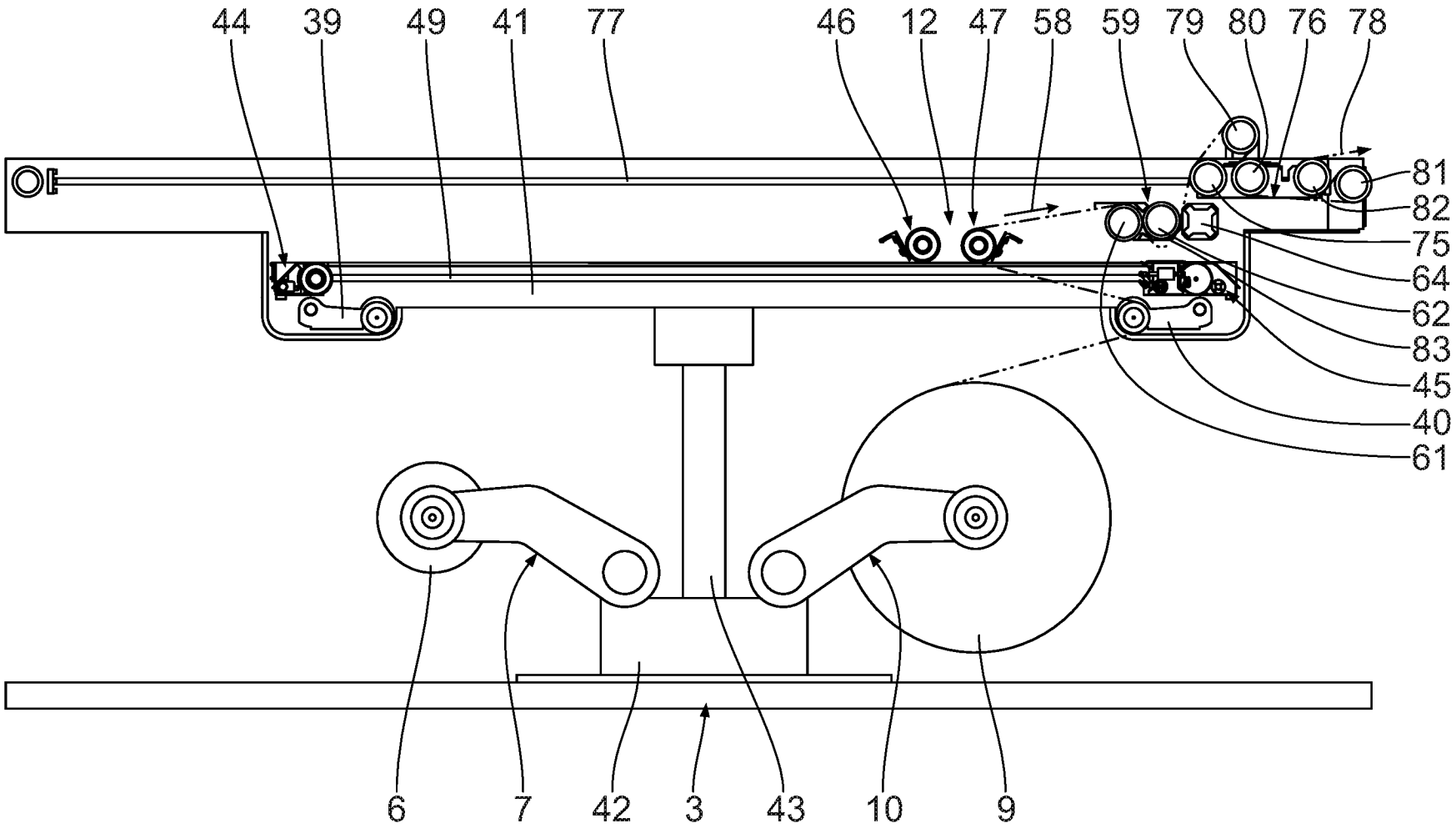
FIG. 5 shows a view corresponding to that of FIG. 4, wherein the behaviour when no respective tensile force is exerted on the threaded finite material web is visualized.

When the tensile force is reduced by the operator, slippage is created between the conveying rollers 61, 62 and the finite second cover web 8. The finite second cover web 8 herein is raised from the second conveying roller 62, while forming a loop 83. The finite second material web 8 is thus no longer conveyed in the conveying direction 58 and in this instance is displaceable in particular in the transverse direction of said finite second material web 8. This is shown in FIG. 5.

When the cover web splicer assembly 3 conveys the endless cover web 11 in a normal manner in order for a multi-layered corrugated cardboard web to be produced, said endless cover web 11 runs through the material web threading assistance assembly 59. The material web threading assistance assembly 59 then favourably facilitates the conveyance of the endless cover web 11 and is driven in a corresponding manner.

The threading of the finite first cover web 5 is performed in an analogous manner. The threading of the finite first intermediate web 13 or of the finite second intermediate web 16 into the intermediate web splicer assembly 4, and the threading of the finite first lamination web 31 or of the finite second lamination web 34 into the lamination web splicer assembly 30, are performed in an analogous manner.

What is claimed is:

1. A splicer assembly for splicing material webs, the splicer assembly comprising:

a first dispensing device for dispensing a finite first material web;

a second dispensing device for dispensing a finite second material web;

a connecting device for connecting the finite first material web and the finite second material web so as to form an endless material web; and a material web threading assistance assembly for assisted threading of one of the finite first material web and the finite second material web into the splicer assembly in a threading procedure, wherein the material web threading assistance assembly comprises at least one conveying installation for conveying the finite material web to be threaded in a threading direction in the threading procedure, and the material web threading assistance assembly further comprises a conveying installation drive installation for driving the at least one conveying installation in the threading procedure, wherein when traction is applied to the threaded finite material web in the threading direction downstream of the material web threading assistance assembly in terms of the threaded finite material web, the at least one conveying installation conveys the threaded finite material web in the threading direction, wherein when insufficient traction is applied to the threaded finite material web in the threading direction downstream of the material web threading assistance assembly in terms of the threaded finite material web, a conveyance of the threaded finite material web by the at least one conveying installation in the threading direction is omitted, wherein when traction is applied to the threaded finite material web in the threading direction downstream of the material web threading assistance assembly in terms of the threaded finite material web, the threaded finite material web at least in regions bears on the at least one conveying installation and via a friction force present between the threaded finite material web and the at least one conveying installation is conveyed in the threading direction, wherein when insufficient traction is applied to the threaded finite material web in the threading direction downstream of the material web threading assistance assembly in terms of the threaded finite material web, slippage arises between the threaded finite material web and the at least one conveying installation, wherein the friction force between the threaded finite material web and the at least one conveying installation in the case of insufficient traction acting on the threaded finite material web is less than in the case of tensile force being exerted.

2. The splicer assembly according to claim 1, wherein the at least one conveying installation in the threading procedure conveys the finite material web to be threaded at a threading speed which is lower than a conveying speed of the splicer assembly when conveying the endless material web for production of a multi-layered web.

3. The splicer assembly according to claim 2, wherein the threading speed is at most ten percent of the conveying speed of the splicer assembly when conveying the endless material web.

4. The splicer assembly according to claim 2, wherein the multi-layered web is a corrugated cardboard web.

5. The splicer assembly according to claim 1, wherein the material web threading assistance assembly is manually activatable for the threading procedure.

6. The splicer assembly according to claim 1, wherein the material web threading assistance assembly is able to be set in operation for the threading procedure only when a minimum safety spacing is maintained between a storage truck of the splicer assembly for conveying without interruptions the endless material web and the at least one conveying installation.

7. The splicer assembly according to claim 1, wherein the material web threading assistance assembly in terms of the finite material web to be threaded is disposed downstream of the connecting device.

8. The splicer assembly according to claim 1, wherein the material web threading assistance assembly in terms of the finite material web to be threaded is disposed upstream of a storage truck of the splicer assembly.

9. The splicer assembly according to claim 1, wherein the material web threading assistance assembly and a storage truck of the splicer assembly in the threading procedure are disposed so as to be mutually adjacent.

10. The splicer assembly according to claim 1, wherein the conveying installation drive installation in the threading procedure is impinged with a nominal torque predefined by a control unit.

11. The splicer assembly according to claim 1, wherein at least one material web deflection roller which is disposed above a storage truck guide for displacing a storage truck of the splicer assembly in terms of the finite material web to be threaded is disposed downstream of the material web threading assistance assembly.

12. The splicer assembly according to claim 1, wherein the material web threading assistance assembly has at least one protective element which for the protection of an operator at least in regions is disposed so as to be adjacent to at least one of the at least one conveying installation and the conveying installation drive installation.

13. The splicer assembly according to claim 1, wherein the at least one conveying installation at least in regions externally has a friction face for engaging on the finite material web to be threaded and permitting conveying the finite material web.

14. The splicer assembly according to claim 13, wherein the at least one conveying installation is formed by at least one conveying roller.

15. The splicer assembly according to claim 14, wherein two of the conveying rollers are present.

16. The splicer assembly according to claim 14, wherein the conveying rollers in the threading procedure are driven in mutually opposite directions.

17. The splicer assembly according to claim 14, wherein the conveying rollers are intercoupled by a coupling assembly.

18. The splicer assembly according to claim 1, wherein the connecting device comprises a first preparation installation, a second preparation installation, a first connecting installation for connecting a web end of the finite first material web to a web lead of the second material web, a second connecting installation for connecting a web end of the finite second material web to a web lead of the finite first material web, and a table installation for interacting with the first preparation installation, the second preparation installation, the first connecting installation and the second connecting installation.

19. A method for splicing material webs, the method comprising the following steps:

dispensing a finite first material web by a first dispensing device;

dispensing a finite second material web by a second dispensing device;

connecting the finite first material web and the finite second material web by a connecting device so as to form an endless material web; and assisted threading of one of the finite first material web and the finite second material web into a splicer assembly in a threading procedure by a material web threading assistance assembly, wherein at least one conveying installation of the material web threading assistance assembly in the threading procedure drives the finite material web to be threaded in a threading direction, wherein a conveying installation drive installation of the material web threading assistance assembly in the threading procedure drives the at least one conveying installation, wherein when traction is applied to the threaded finite material web in the threading direction downstream of the material web threading assistance assembly in terms of the threaded finite material web, the at least one conveying installation conveys the threaded finite material web in the threading direction, wherein when insufficient traction is applied to the threaded finite material web in the threading direction downstream of the material web threading assistance assembly in terms of the threaded finite material web, a conveyance of the threaded finite material web by the at least one conveying installation in the threading direction is omitted, wherein when traction is applied to the threaded finite material web in the threading direction downstream of the material web threading assistance assembly in terms of the threaded finite material web, the threaded finite material web at least in regions bears on the at least one conveying installation and via a friction force present between the threaded finite material web and the at least one conveying installation is conveyed in the threading direction, wherein when insufficient traction is applied to the threaded finite material web in the threading direction downstream of the material web threading assistance assembly in terms of the threaded finite material web, slippage arises between the threaded finite material web and the at least one conveying installation, wherein the friction force between the threaded finite material web and the at least one conveying installation in the case of insufficient traction acting on the threaded finite material web is less than in the case of tensile force being exerted.

20. The method according to claim 19, wherein the connecting device comprises a first preparation installation, a second preparation installation, a first connecting installation for connecting a web end of the finite first material web to a web lead of the second material web, a second connecting installation for connecting a web end of the finite second material web to a web lead of the finite first material web, and a table installation for interacting with the first preparation installation, the second preparation installation, the first connecting installation and the second connecting installation.

* * * * *